United States Patent [19]

Walker

[11] 4,062,265

[45] Dec. 13, 1977

[54] STRING INSTRUMENT TUNING SYSTEM

[76] Inventor: William C. Walker, 7854 I Bruton Court, Glen Burnie, Md. 21016

[21] Appl. No.: 647,979

[22] Filed: Jan. 9, 1976

[51] Int. Cl.[2] ..... G10D 3/14

[52] U.S. Cl. ..... 84/312 R; 84/304; 116/124 A; 116/133

[58] Field of Search ..... 84/200–208, 84/297 R, 304–306, 312; 116/116, 133, 124 A

[56] References Cited

U.S. PATENT DOCUMENTS

| | | | |
|---|---|---|---|
| 668,138 | 2/1901 | Brandon | 84/306 |
| 2,995,105 | 8/1961 | Maltby | 116/133 |
| 3,340,751 | 9/1967 | Figgis | 116/133 X |
| 3,403,588 | 10/1968 | Downing | 84/306 |

*Primary Examiner*—Lawrence R. Franklin
*Attorney, Agent, or Firm*—Morton J. Rosenberg

[57] ABSTRACT

A musical instrument tuning system adapted to be mounted on a string instrument. The tuning system provides a visual indication to repeatedly aid in the proper tuning of a set of strings. Additionally, the tuning system gives a visual indication when a string is tension loaded to or near the rupture point. Further, the tuning system indicates when a string is below pitch after a reference point is set to provide proper tuning of a particular string. The tuning system mounted on the instrument pegboard includes a first decalcomania having three indicia zones representing a proper tuning zone, a string tension load warning zone and a zone indicating the appropriate string is below pitch. A second decalcomania mounted on a peg has indicia which is aligned with the first decalcomania tuning zone. Rotation of the peg resulting in alignment of the peg indicia with the tension load warning zone indicates a warning to the user that the string may rupture. Opposite rotation of the peg resulting in alignment of the peg indicia with the below pitch zone indicates that the string is not properly tuned.

8 Claims, 4 Drawing Figures

FIG. 1
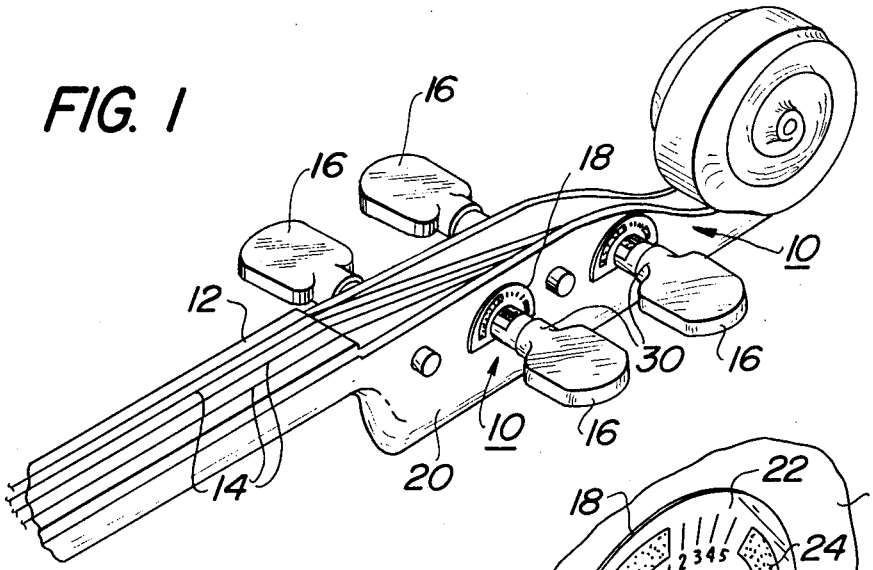
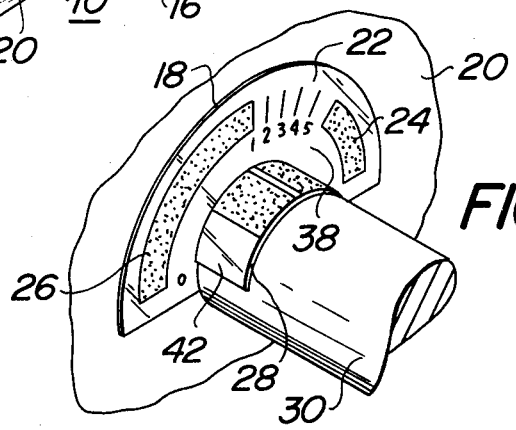
FIG. 2
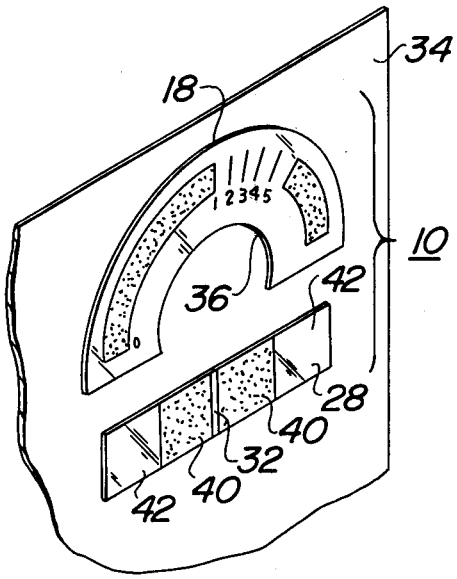
FIG. 3
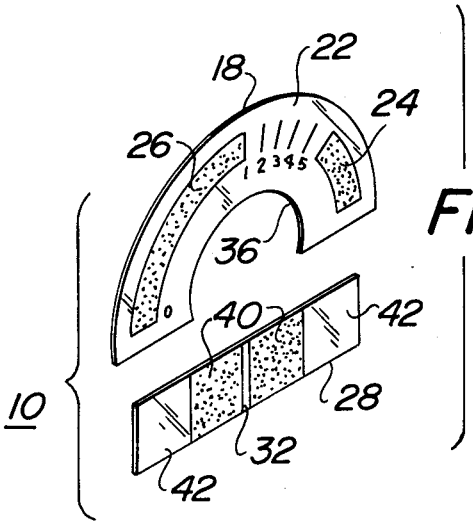
FIG. 4

STRING INSTRUMENT TUNING SYSTEM

BACKGROUND OF THE INVENTION

1. Field of the Invention

This invention relates to musical instruments. In particular, this invention pertains to tuning of musical instruments. More in particular, this invention pertains to the tuning of string instruments. Further, this invention relates to the tuning of string instruments through visual indications which are easily discernable. Additionally, this invention pertains to systems having alignable indicia on decalcomania which permits visual indication of the proper tuning of a string instrument.

2. Prior Art

Tuning of string instruments by applying proper tension loading on the appropriate strings is known in the art. However, tuning is generally accomplished manually by audio correlation. In prior systems, the instructor would tune the string instrument by appropriately rotating a peg to provide a proper tension load in an associated string. During a time interval, the peg may be inadvertently rotated or the string stretched which results in an incorrect string pitch.

Generally, the student or other inexperienced user would have to wait until the instructor would tune the instrument or the student would attempt to tune the instrument themself. When trying to tune this instrument themselves, the students would run the danger of overloading the string causing rupture.

Where the string is only slightly out of pitch, the student would have to tune the instrument through audio correlation. Audio tuning is a difficult chore when being done by an inexperienced operator. Much time may be lost in tuning the instrument in such a manner.

SUMMARY OF THE INVENTION

A string instrument tuning system having a first indication member which is mounted to a peg box of the string instrument. The first indication member includes a plurality of indicia zones. A second indication member is mounted to a peg of the string instrument and has cooperative indicia for alignment with the first indication member at a predetermined point in at least one of the indicia zones in order to determine the tension of a string of the instrument.

BRIEF DESCRIPTION OF THE DRAWINGS

FIG. 1 is an isometric view of a portion of a string instrument showing the instrument tuning system attached to the peg board of the instrument;

FIG. 2 is an enlarged perspective view of a portion of the string instrument showing an enlarged section where the tuning system is attached to the pegboard of the instrument;

FIG. 3 is a perspective view of the instrument tuning system adhesively secured to a carrier sheet; and, FIG. 4 is a perspective view of the tuning system first and second indication members removed from the carrier sheet.

DESCRIPTION OF THE PREFERRED EMBODIMENT

Referring now to FIGS. 1–4 there is shown string instrument tuning system 10 for use in aiding a user to approximate the appropriate tension load in a particular or set of strings 14 of instrument 12. Less technically, system 10 allows the user to correctly tune string instrument 12 while providing a visual warning aid to prevent strings 14 from being tension loaded to a point where strings 14 may possibly rupture. Thus, tuning system 10 allows the user to manually rotate peg 16 to a predetermined point which gives a visual indication that the proper pitch of a predetermined string 14 has been reached.

String instrument tuning system 10 includes first indication member or decalcomania 18 which is mounted to peg box 20 substantially as is shown in FIGS. 1 and 2. First indication member 18 includes first indicia zone 22, second indicia zone 24, and third indicia zone 26; the uses of which will be described in following paragraphs.

Tuning system 10 further includes second indication member or second decalcomania 28 which is adapted to be mounted to neck portion 30 of peg 16 of string instrument 12. Second indication member 28 includes cooperative indicia 32 for alignment with first indication member 18 at some predetermined point in at least one of indicia zones 24, 26, and 22 for determining an appropriate tension of an associated string 14 of instrument 12.

Prior to use, tuning system 10 may be mounted on decalcomania carrier 34 as is shown in FIG. 3. First and second indication members 18 and 28 may be mounted on carrier 34 through an adhesive mechanism well known in the art. The only criteria of importance being that both indication member 18 and indication member 28 be easily removeable from carrier 34. Carrier 34 may include a low surface tension outer surface in order that members 18 and 28 be easily removed from carrier 34. Each of members 18 and 28 has an adhesive backing in order that they may be adhered to the appropriate portions of instrument 12. Additionally, it is to be understood that a series of indication members 18 and 28 making up the appropriate elements of tuning system 10 be maintained on one total carrier sheet 34.

Indication or decalcomania members 18 and 28 are peeled or otherwise removed from carrier sheet 34 as is shown in FIG. 4. First indication member 18 is then adhesively secured to peg box 20 of string instrument 12 in a manner appropriately shown in FIGS. 1 and 2. The particular positioning of indication member 18 is not of particular inventive significance with the exception that first decalcomania member 18 be positioned adjacent at least a portion of the peripheral boundary of neck 30 of peg 16. In the embodiment shown in FIGS. 1–4, first indication member 18 includes an annular contour which includes inner circle contour 36 which is easily mated to the general cylindrical contour outline of neck portion 30 of peg 16.

In operation, peg 16 is rotated in a manner to provide tension on an associated string 14. Peg 16 is rotated until the proper pitch of string 14 is reached, determined by audio correlation or some like technique. Once the proper pitch of string 14 has been found, second indication or decalcomania 28 is secured through adhesion to neck portion 30 in a manner such that cooperative indicia 32 is aligned with one of numerals 38 within first indicia zone 22. This now provides a reference or a base visual aid to determine the appropriate pitch of string 14. Numerals 38 include a series of indication marks through which cooperative indicia 32 may further be aligned at different time intervals to accomodate the stretching of string 14.

Thus, an inexperienced user may initially have cooperative indicia 32 aligned with the numeral "1" or other initial indicating mark within zone 22. During use, throughout a series of time intervals, string 14 may be stretched or otherwise displaced. This may require retuning of instrument 12 and indicia 32 may have to be set at the numeral "2" or to some other indicia mark in first indicia zone 22. However, once cooperative indicia 32 on second indication member 28 is aligned, repeatability of pitch of string 14 may be generally, if not exactly, maintained.

Included in first indication member 18 is second indicia zone 24 which is a warning zone that string 14 has reached its maximum tension and that there may be breakage of string 14 if peg 16 were rotated any further. Second indicia zone 24 would preferably be of a different color or have other visual individuality when taken with respect to first indicia zone 22. Thus, when cooperative indicia 32 is rotated into zone 24, it becomes immediately apparent that the user may expect breakage of string 14. When an inexperienced user tries to tune string 14, the alignment of indicia 32 with second indicia zone 24 gives a clear visual indication of a possible rupture of string 14 and gives a warning that an inadvertent breakage of string 14 may occur.

First indication member 18 further includes third indicia zone 26 which when cooperative indicia 32 is aligned at some predetermined point within zone 26 provides an indication that string 14 is below the set pitch which the user desires. Thus, when cooperative indicia 32 has been aligned with, for example, the numeral "1" within zone 22, rotation of peg 16 in a counterclockwise direction through jarring or other displacement would give an immediate indication to the user that associated string 14 is below the desired pitch.

As is clearly seen in FIGS. 2, 3, and 4 cooperative indicia 32 of second indication member 28 is outlined by a pair of independently colored extending members 40 which allows cooperative indicia 32 to be easily and visually outlined. Flaps 42, extend beyond members 40 and allow the user to manually place second indication member 28 over neck portion 30 of peg 16 in a manner which would not interfere with the positioning of cooperative indicia 32.

The method of utilizing tuning system 10 to provide for repeatable tuning of an appropriate string 14 of instrument 12 is initiated by removing first indication member 18 from carrier sheet 34. First indication member 18 is then adhesively secured to peg box 20 of instrument 12 surrounding a portion of neck 30 of peg 16.

Peg 16 is rotated until string 14 is brought to the proper pitch. Second indication or decalcomania 28 is removed from carrier sheet 34. Member 28 is then adhesively secured to neck 30 of peg 16 in a position such that cooperative indicia 32 is aligned with one of the initial numerals 38 within first indicia zone 22. This now serves as a base reference for tensioning of string 14 to the proper pitch desired by the operator or user.

During use or throughout some time interval for other reasons, string 14 may be displaced or peg 16 may be rotated inadvertently. Where peg 16 has been inadvertently rotated, string 14 may be brought to the proper pitch by repositioning peg 16 such that cooperative indicia 32 is brought into alignment with the initial numeral within zone 22. If string 14 has been stretched, cooperative indicia 32 may be realigned with another numeral 38 within zone 22 and this now becomes the base reference for the proper pitch of string 14.

When the user is rotating peg 16, visual zone 24 provides the user with an area within which a warning is provided in that there is a possibility that string 14 will break when cooperative indicia 32 is aligned at a predetermined point within second indicia zone 24. Further, the user is made aware that string 14 is below the appropriate pitch when cooperative indicia 32 is aligned within third indicia zone 26 as has hereinbefore been described.

In this manner, the user is provided with a series of indications on the tuning of instrument 12. In particular, approximate repeatability of tuning is provided by first indicia zone 22 is cooperation with indicia 32 on second indication member 28. A visual warning area is provided by second indicia zone 24 which will stop the inexperienced user from breaking string 14 by turning peg 16 through too much of a rotation. Still further, third indicia zone 26 provides a broad area within which the user is made aware at once that when cooperative indicia 32 is aligned within third indicia zone 26 that there is an indication that string 14 is below the appropriate pitch.

Although this invention has been described in connection with specific forms thereof, it will be appreciated that various modifications other than those discussed above may be resorted to without departing from the spirit or scope of the invention. For example, equivalent elemental structures may be substituted for those specifically shown and described, certain features may be used independently of other features, and in some cases, portions may be reversed, all without departing from the spirit or scope of the invention as defined in the appended claims.

What is claimed is:

1. A tuning system for a musical instrument, comprising:

a peg box having tuning pegs rotatively mounted thereon, each of said pegs having a string attached thereto, whereby rotation of said each peg varies the tension in its associated string;

a first decalcomania adhesively secured to said box substantially adjacent at least one of said pegs, said first decalcomania having indicia zones printed thereon; and a second decalcomania adhesively secured to the neck of said one peg adjacent to said first decalcomania, said second decalcomania having an index thereon registrable with said indicia zones to indicate the rotative position of said peg relative to said box and thereby indicate the relative tension in the said associated string.

2. The string instrument tuning system as recited in claim 1 where said first decalcomania means is positioned adjacent at least a portion of a peripheral boundary of a neck segment of said peg.

3. A method for tuning a string instrument including the steps of:

a. adhesively securing a first decalcomania to a peg box of said string instrument substantially adjacent to one of the string tuning pegs rotatively mounted on said peg box, said first decalcomania having indicia zones printed thereon;

b. tuning the string attached to said one tuning peg; and c. adhesively securing a second decalcomania to the neck of said one peg adjacent to said first decalcomania while aligning an index printed on said second decalcomania with a predetermined point within one of said indicia zones.

4. A tuning system for a musical instrument having strings, a peg box, and tuning pegs mounted on said box for varying the tension in said strings, comprising:

a first decalcomania adapted to be adhesively secured to said box substantially adjacent one of said pegs, said decalcomania having indicia zones printed thereon; and a second decalcomania adapted to, be adhesively secured to the neck of said one peg adjacent to said first decalcomania, said second decalcomania having an index thereon registrable with said indicia zones to indicate the rotative position of said peg relative to said tuning head and thereby indicate the relative tension in the string attached to said peg.

5. The string instrument tuning system as recited in claim 4 where said first decalcomania means includes a first indicia zone having indicia markings for alignment with said index for determining the appropriate pitch of said string controlled by said peg.

6. The string instrument tuning system as recited in claim 5 where said first decalcomania means includes a second indicia zone defining a string tension warning zone for indicating an area where said string may break when said index is aligned with said second indicia zone.

7. The string instrument system as recited in claim 5 where said first decalcomania means includes a third indicia zone for indicating an area where said string is below a predetermined pitch value when said index is aligned with said third indicia zone.

8. The string instrument tuning system as recited in claim 4 where said first decalcomania means includes at least a portion of an annular contour being adapted to be mounted adjacent at least a portion of a peripheral boundary of an associated peg.

* * * * *